United States Patent [19]

Finger

[11] 4,192,009

[45] Mar. 4, 1980

[54] COULOMETRIC DEVICE FOR PERFORMING TIME INTEGRATION

[75] Inventor: Eugene P. Finger, Brewster, N.Y.

[73] Assignee: Curtis Instruments, Inc., Mount Kisco, N.Y.

[21] Appl. No.: 885,279

[22] Filed: Mar. 10, 1978

[51] Int. Cl.[2] ..... G06G 7/18; G06G 7/161

[52] U.S. Cl. ..... 364/829; 324/94; 324/142; 324/182

[58] Field of Search ..... 324/182, 142, 94; 365/153; 364/829, 834

[56] References Cited

U.S. PATENT DOCUMENTS

| | | | |
|---|---|---|---|
| Re. 27,556 | 1/1973 | Corrsin | 324/182 |
| 3,387,288 | 6/1968 | Bisset et al. | 324/182 X |
| 3,462,684 | 8/1969 | Beusman | 324/182 X |
| 3,518,501 | 6/1970 | Bisset et al. | 324/142 X |
| 3,577,168 | 5/1971 | Tuten | 324/182 X |
| 3,603,880 | 9/1971 | Brecker et al. | 324/182 |
| 3,680,063 | 7/1972 | Pinto | 365/153 |
| 3,704,431 | 11/1972 | Finger | 324/94 |
| 3,725,774 | 4/1973 | Stewart, Jr. | 324/142 |
| 3,875,505 | 4/1975 | Goldberg | 324/182 X |
| 3,938,128 | 2/1976 | Pidsosny et al. | 324/182 X |
| 3,972,022 | 7/1976 | Goto et al. | 324/182 X |

*Primary Examiner*—Felix D. Gruber
*Attorney, Agent, or Firm*—Pennie & Edmonds

[57] ABSTRACT

A coulometric device for performing integration or timing functions with precise end-state detection comprises a coulometer; serially connected to the coulometer, a source of pulsed d.c. current representative of one or more quantities to be integrated; and a pulse height discriminator for detecting a reduction in the voltage drop across the coulometer. One variable to be integrated can vary either the duty cycle of the pulsed d.c. current source or the peak current, and the product of two variables can be time-integrated by using one variable to vary the duty cycle and the other to vary the peak current.

10 Claims, 16 Drawing Figures

COULOMETRIC DEVICE FOR PERFORMING TIME INTEGRATION

BACKGROUND OF THE INVENTION

1. Field of the Invention

This invention relates to a coulometric device for performing integration and timing functions with precise end-state detection.

2. History of the Art

Coulometric devices for performing time integration are disclosed in U.S. Pat. No. 3,045,178 issued to Lester Corrsin on July 17, 1962. Such devices typically comprise a body of electrically non-conductive material having a bore therethrough which supports two columns of mercury, the adjacent inmost ends of which are separated by, but maintained in contact with a small volume of liquid electrolyte. The outermost ends of the two metal columns are maintained in contact with suitable conductive leads provided to connect the instrument to a source of electrical current. The flow of electrical current from one metal column to the other through the electrolyte causes metallic ions to migrate from the positive column (anode) to the negative column (cathode). In accordance with Faraday's law, the liquid metal is electroplated from the anode column to the cathode column, causing the anode column to decrease in length and the cathode column to elongate correspondingly, the change in column length being directly proportional to the total electric charge passed through the device. When such a device is connected to a source of constant direct current, readout of the measured time-current product may be effected by comparison of one column length against a calibrated scale.

In the operation of such a device, it is frequently desirable to detect electrically the end state of device operation wherein one of the electrodes penetrates the moving electrolyte gap and finally bridges it, shorting out the electrolyte. U.S. Pat. No. 3,462,684 issued to Curtis C. Beusman, discloses one such detection scheme wherein an a.c. voltage source is connected across the coulometer and an a.c. voltage detector is provided to measure the a.c. voltage drop across the coulometer. End-state operation is detected by a reduction in the a.c. voltage drop across the coulometer.

While the a.c. end-state detection is useful in many applications, it is subject to certain inherent inaccuracies. It has been found very difficult to construct a coulometer with characteristics that are precisely matched for both positive and negative current flow. Impurities and non-homogeneities can cause impedance to appear different for positive current flow than for negative flow, with the consequence that high amplitude a.c. signals can produce a finite d.c. component in series with the coulometer. This d.c. component can produce a measurable error in the coulometer readout.

Accordingly, there is a need for a coulometric device provided with means for precise end-state detection.

SUMMARY OF THE INVENTION

In accordance with the present invention, a coulometric device for performing integration or timing functions with precise end-state detection comprises a coulometer; serially connected to the coulometer, a source of pulsed d.c. current representative of one or more quantities to be integrated; and a pulse height discriminator for detecting a reduction in the voltage drop across the coulometer. The device provides for interrogation by the same signal which it integrates. One variable to be integrated can vary either the duty cycle of the pulsed d.c. current source or the peak current, and the product of two variables can be time-integrated by using one variable to vary the duty cycle and the other to vary the peak current.

BRIEF DESCRIPTION OF THE DRAWINGS

The nature, advantages, and various features of the invention will appear more fully upon consideration of the illustrative embodiments now to be described in detail in connection with the accompanying drawings.

In the drawings.

For convenience of reference, the same circuit components are given the same reference numerals throughout the drawings.

DETAILED DESCRIPTION OF THE DRAWINGS

1. Elapsed Time Indicators (FIGS. 1-6)

Figure 1:
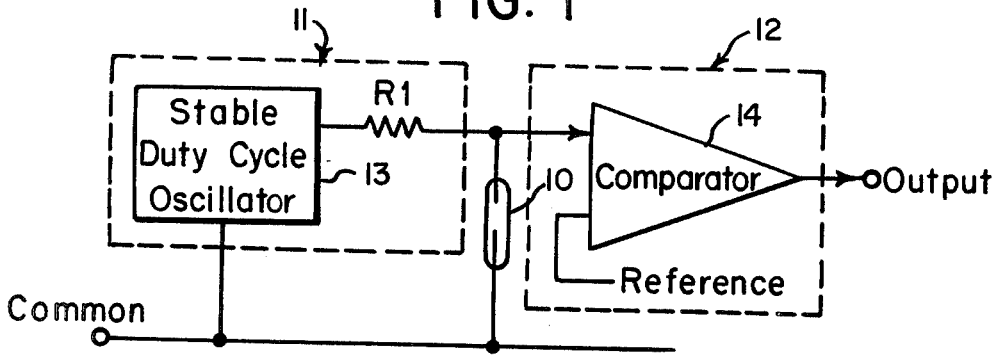
FIG. 1 is a block diagram of an elapsed time indicator in accordance with the invention.

Referring to the drawings, FIG. 1 is a block diagram of an elapsed time indicator in accordance with the invention comprising, in substance, a coulometer 10, a source 11, of pulsed d.c. current for applying a series of d.c. current pulses through the coulometer; and a detection circuit 12 for detecting a reduction in the voltage drop across coulometer 10 when it reaches its end-state. In a preferred embodiment, the source of pulsed d.c. current can comprise a stable duty cycle oscillator 13 and a series resistor $R_1$. The oscillator is designed so that it always has a d.c. component and preferably has an output which is a unidirectional pulse train. To permit the use of an inexpensive detection circuit, the peak current from source 11 should approach the maximum current rating (i.e., current density) of coulometer 10. The detector 12 can conveniently comprise a comparator 14 for comparing the voltage drop across the coulometer with a reference voltage source (not shown), greater than the voltage drop across the shorted coulometer. Thus, the output of detector 12 is a pulse train during the timing run of the coulometer and zero when the coulometer has shorted out. As will be apparent, this detection scheme in effect uses the signal that is integrated by the coulometer to interrogate it as well.

Figure 2:
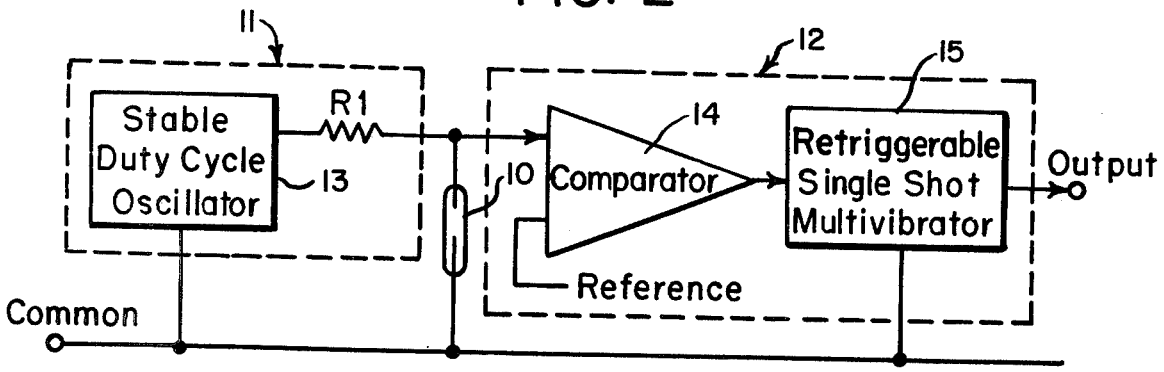
FIG. 2 is a variation of the elapsed time indicator of FIG. 1 provided with a single-shot output.

FIG. 2 illustrates a variation of the elapsed time indicator of FIG. 1 wherein the detector 12 additionally comprises a retriggerable single shot multivibrator 15 responsive to the output of comparator 14. When the pulse width of the multivibrator 15 is chosen to be longer than the longest anticipated period of oscillator 11, the output of detector 12 will be a steady d.c. voltage during the period of the timing run and zero when the coulometer shorts. The retriggerability of the multivibrator precludes glitches in the output.

Figure 3:
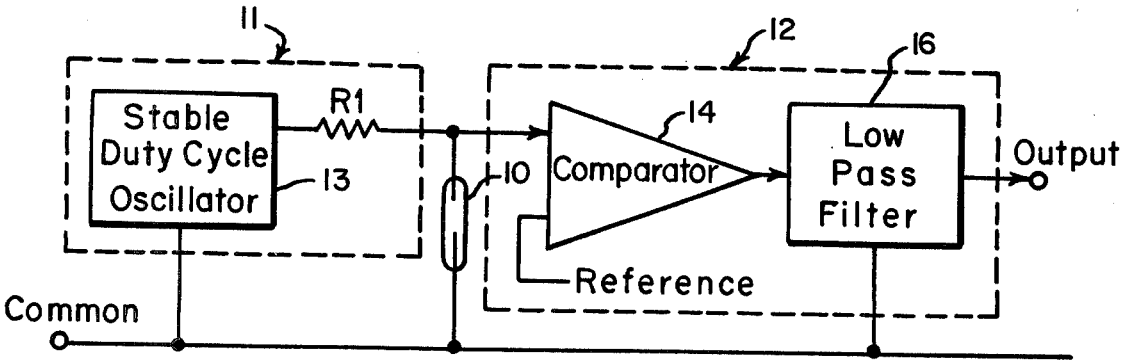
FIG. 3 is a variation of the elapsed time indicator of FIG. 1 provided with a low pass filter output.

FIG. 3 illustrates a variation of the elapsed time indicator of FIG. 1 wherein the detector 12 additionally comprises a low pass filter 16 responsive to the output of comparator 14. Again the output is a d.c. voltage during the timing run and zero upon coulometer shorting.

Figure 4:
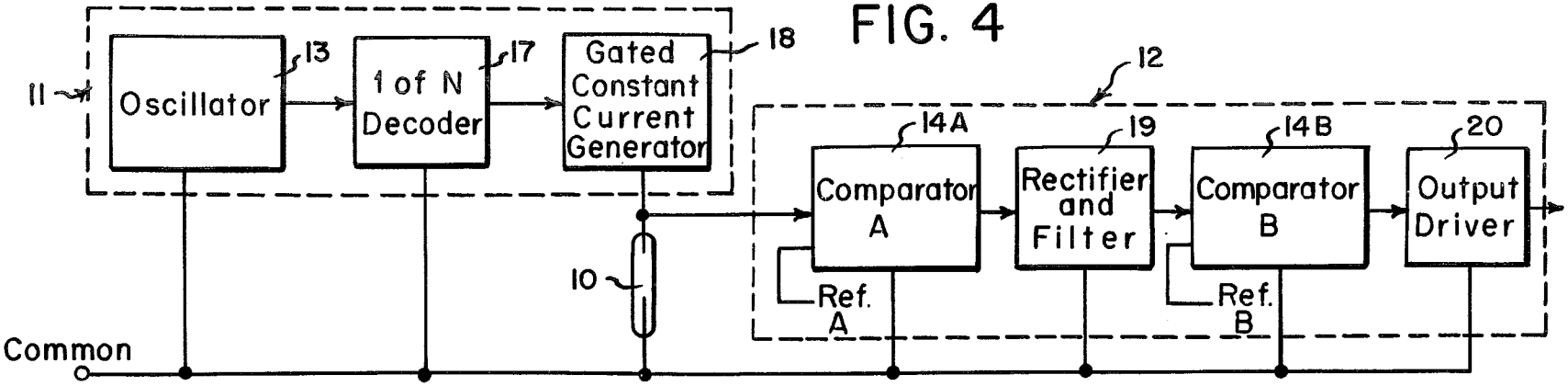
FIG. 4 is a block diagram of a high accuracy elapsed time indicator in accordance with the invention.

FIG. 4 is a block diagram illustrating a high accuracy elapsed time indicator. Here source 11 of d.c. pulsed current comprises an oscillator 13, a 1 of N decoder 17 responsive to the output of the oscillator, and a gated constant current generator 18, responsive to the output of decoder 17. Detection circuit 12 comprises a first comparator 14A and a rectifier and filter 19 responsive to the output of comparator 14A for converting the pulsed d.c. output into a steady d.c. voltage. A second comparator 14B responds to a reduced level output of filter 19 to activate output driver 20 which can, for example, activate a LED indicator (not shown) upon detection of coulometer shorting.

Figure 5:
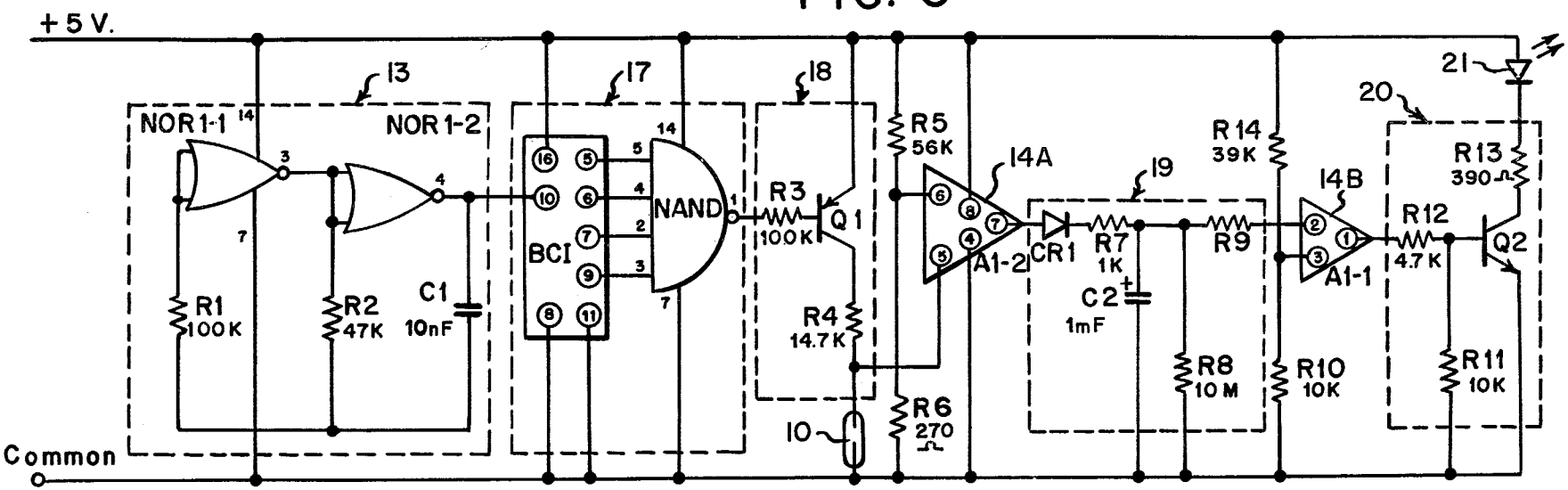
FIG. 5 is a schematic circuit diagram of the FIG. 4 elapsed time indicator.

The structure and operation of the embodiment of FIG. 4 can be better understood by reference to FIG. 5 which is an exemplary schematic circuit diagram of the FIG. 4 device.

Oscillator 13 comprises the gates NOR 1-1, NOR 1-2, resistors $R_1$ and $R_2$ and capacitor $C_1$. With the component values illustrated, it has a frequency of approximately 500 Hertz.

The 1 of N decoder is formed by binary counter BC1 and gate NAND. In this example, it operates at a duty cycle of 1 part in 16.

Gated constant current generator 18 comprises resistors $R_3$, $R_4$, and transistor $Q_1$.

Resistors $R_5$ and $R_6$ generate reference voltage A to comparator 14A which, in this example, is set at 24 millivolts.

The rectifier and filter circuit 19 is formed by rectifying diode CR1, resistors $R_7$, $R_8$, and $R_9$ and capacitor C2. With the component values illustrated, the charging time constant is on the order of 1 millisecond and the discharge time constant is approximately 10 seconds.

Resistors $R_{10}$ and $R_{14}$ generate reference voltage B, to comparator 14B which, in this example, is approximately 1 volt.

Output driver 20 comprises resistors $R_{11}$, $R_{12}$, $R_{13}$, and transistor $Q_2$. It generates 9 milliamperes which can be used to activate light emitting diode 21.

Figure 6:
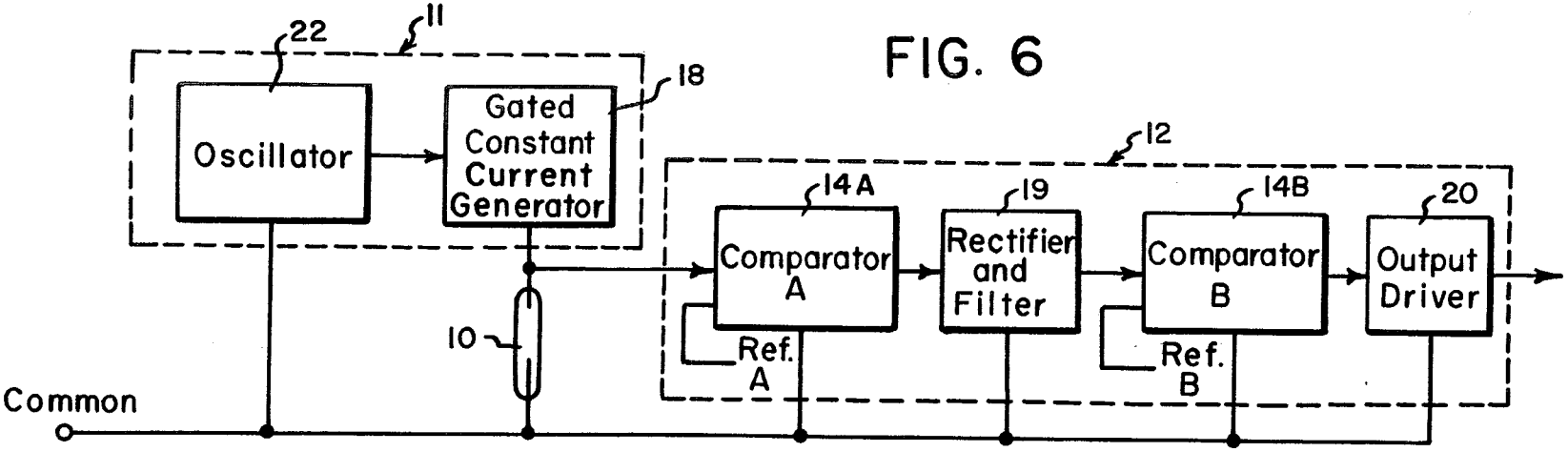
FIG. 6 is a block diagram of a variation of the high accuracy elapsed time indicator of FIG. 4.

FIG. 6 is a block diagram illustrating a variation of the elapsed time indicator of FIG. 1 substantially the same as the FIG. 4 embodiment except that in the source 11 of d.c. pulsed current, the oscillator and 1 of N decoder of FIG. 4 are replaced by a stable duty cycle oscillator 22 such as the LM555C timer manufactured by National Semiconductor Corp.

As will be apparent from the foregoing, in each of the circuits of FIGS. 1–6 the signal that is integrated by the coulometer also interrogates the coulometer. The duty cycle of this signal can range from d.c. to as little as one part in more than approximately 1000. The peak current for the signal applied to the coulometer should be between approximately 100 microamperes and approximately 10 milliamperes for typical coulometers that are presently sold by the assignee.

2. Integrating Circuits (FIGS. 7–12 and 16)

Figure 7:
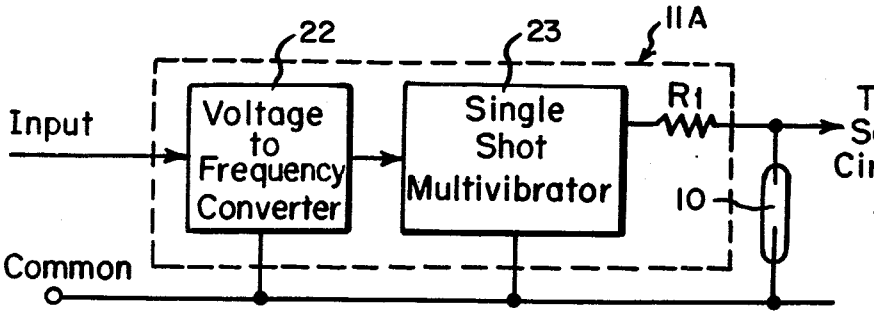
FIG. 7 is a block diagram of an integrating circuit in accordance with the invention.

To provide an integrating circuit, it is only necessary to modify the elapsed time indicators of FIGS. 1–6 to provide a means for modulating the signal that is applied to the coulometer. FIG. 7 is a block diagram of one embodiment of an integrating circuit in accordance with the invention comprising a coulometer 10 and a modulated duty cycle source 11A of d.c. pulsed current. Here the modulated source 11A comprises a repetition-rate modulated source comprising a voltage-to-frequency converter 22, a single shot multivibrator 23 responsive to the output of converter 22 and resistor $R_1$. In operation, the variable input voltage to be integrated is converted to a variable frequency signal in converter 22. This variable frequency signal, in turn, varies the repetition rate of voltage pulses from multivibrator 23 which pass as current pulses through coulometer 10. Coulometer 10 integrates the total current passing therethrough thus providing a measure of the integrated value of the input voltage. Any of the detection circuits 12 shown in FIGS. 1–6 can be used to sense the end-state of coulometer 10 of FIGS. 7–12 and 16.

Figure 8:
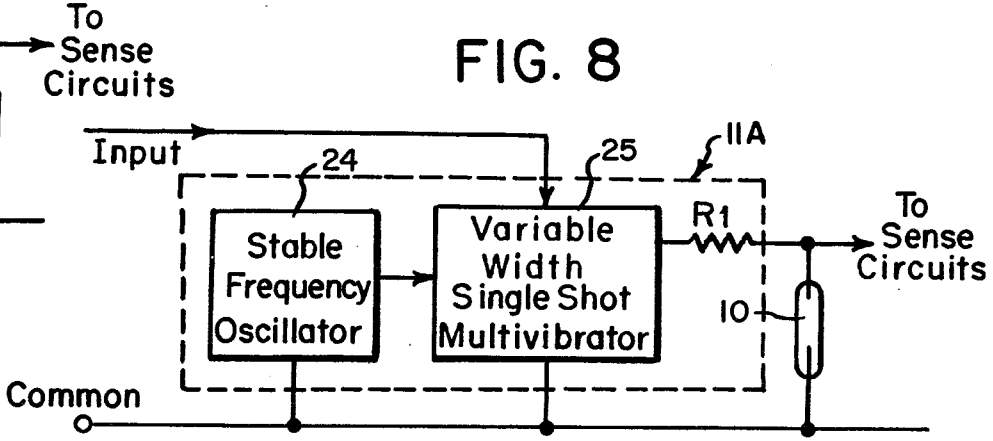
FIG. 8 is a block diagram of a second embodiment of an integrating circuit.

FIG. 8 is a block diagram of a second embodiment of an integrating circuit in accordance with the invention. Here modulated duty cycle source 11A of d.c. pulsed current comprises a stable frequency oscillator 24 and a variable pulse width single shot multivibrator 25. In operation, the output from oscillator 24 is applied to multivibrator 25 to determine the repetition rate for output pulses and the input voltage to be integrated is also applied to the multivibrator to vary the width of the output pulses. Coulometer 10 integrates the total current thus providing a measure of the integrated input voltage.

Figure 9:
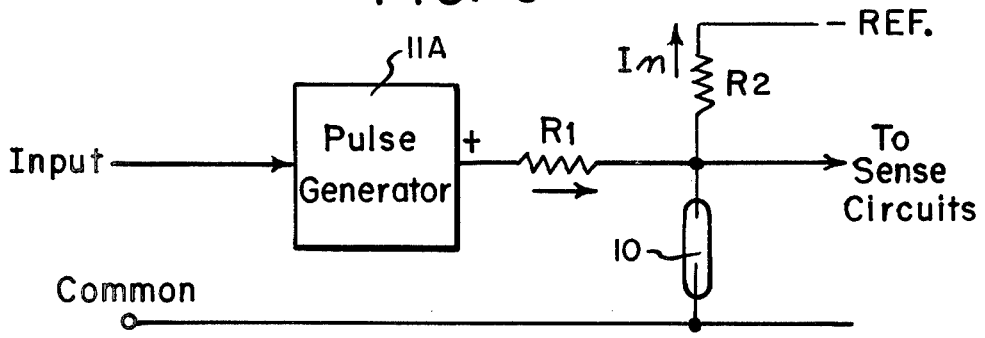
FIGS. 9 and 10 illustrate circuits for applying reference voltages to bias integrating coulometers with nulling currents.
Figure 10:
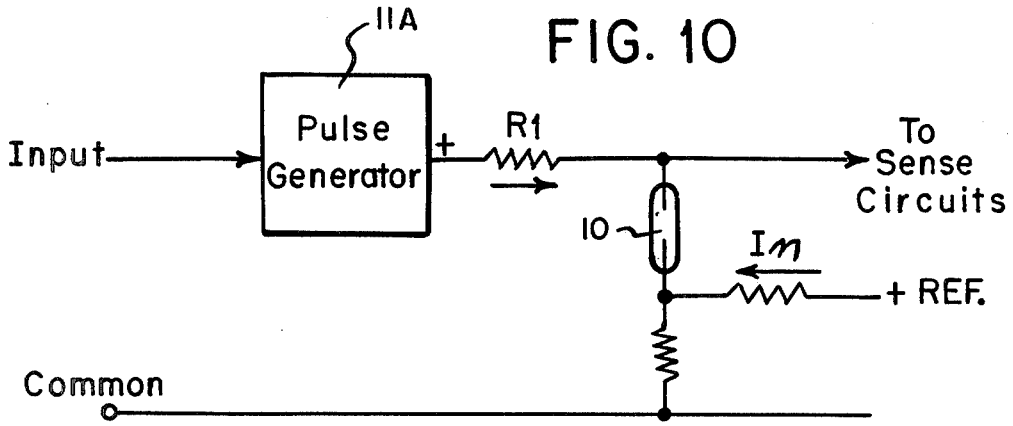

In the embodiments of FIGS. 7 and 8, the lowest pulse repetition rate and the lowest pulse width, respectively, should be held to sufficiently large values that the coulometric state (shorted or non-shorted) can be monitored. These limitations mean that some finite current value is applied to the coulometer even if the input is zero. In order to obtain a true zero integration current for zero input while maintaining a sensible interrogation pulse train, it is necessary to bias the coulometer with a d.c. nulling current. FIGS. 9 and 10 illustrate two ways for applying reference voltages, REF, to bias integrating coulometer with nulling currents $I_n$.

Figure 11:
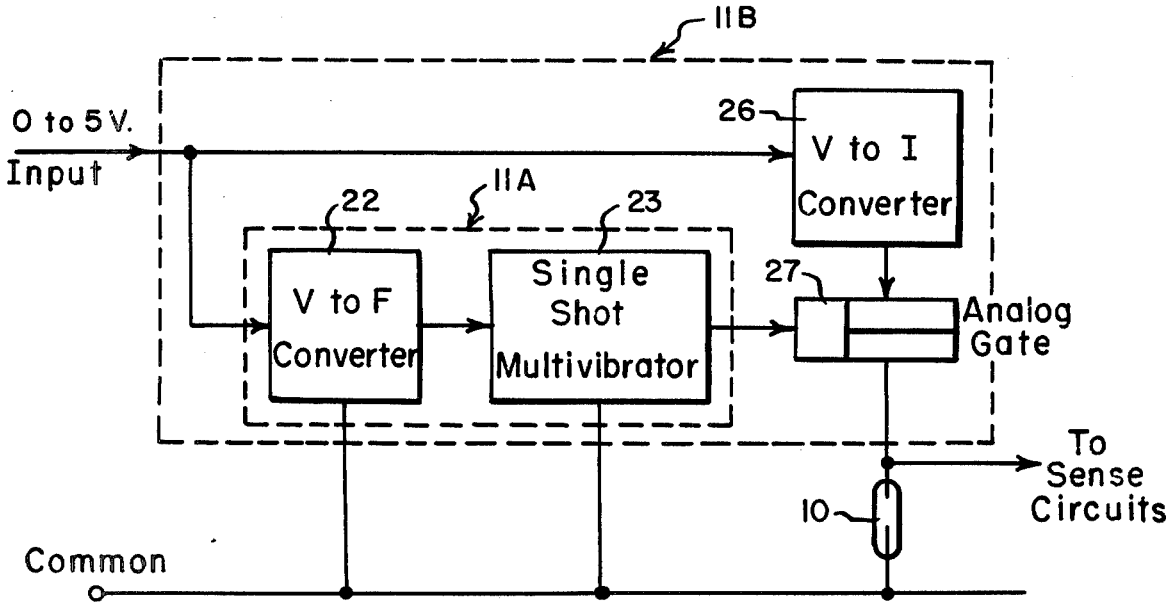
FIG. 11 is a block diagram of a high dynamic range integrating circuit in accordance with the invention.

FIG. 11 is a block diagram of a high dynamic range integrator in accordance with the invention. Here the source 11B of pulsed d.c. current is one which can be modulated both in duty cycle and in amplitude. Specifically, in this embodiment, the input voltage is applied to both a modulated duty cycle source 11A of current pulses but, also, through a voltage to current converter 26, it is applied to an analog gate 27, to modulate the amplitude of current pulses from source 11A applied to coulometer 10. Using this arrangement, practical coulomb-per-pulse ranges from 10000/1 to 1 million/1 are possible.

Figure 12:
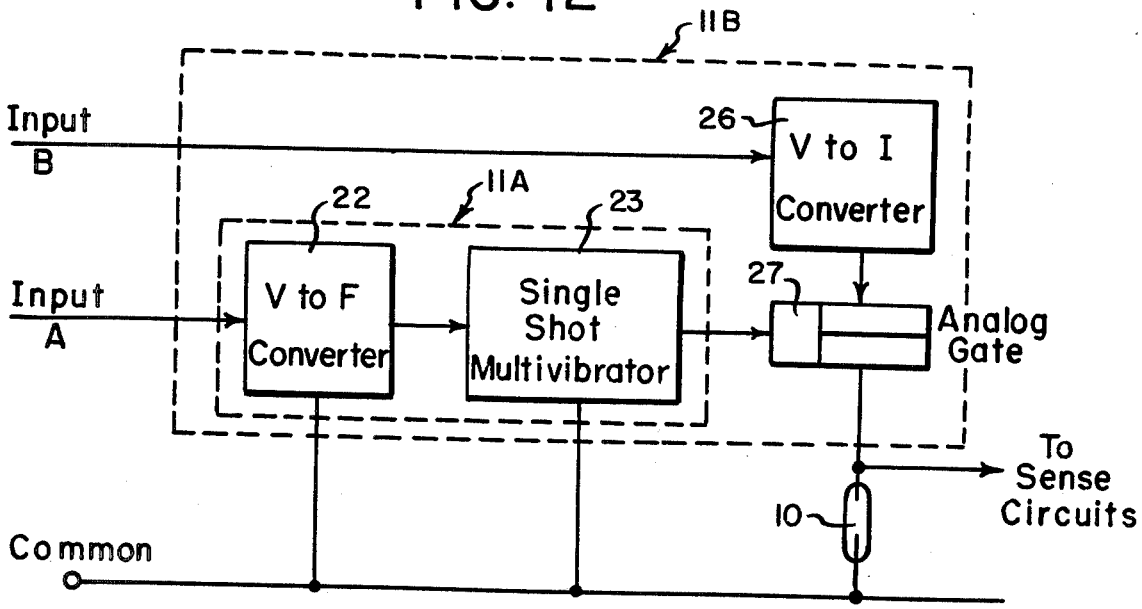
FIG. 12 is a block diagram of a two variable integrating circuit in accordance with the invention.

FIG. 12 is a block diagram of a two variable integrating circuit in accordance with the invention. This arrangement is similar to the arrangement of FIG. 11, except that one input variable, input A, is used to modulate the current pulse duty cycle and a second input variable, input B, is used to modulate the pulse amplitude. The variable having the greater dynamic range preferably modulates the duty cycle. Such an integrator could be used, for example, as a watt-hour integrator wherein input A could be current, having a practical dynamic range of about 100/1 and input B could be voltage having a range of about 2/1.

Figure 16:
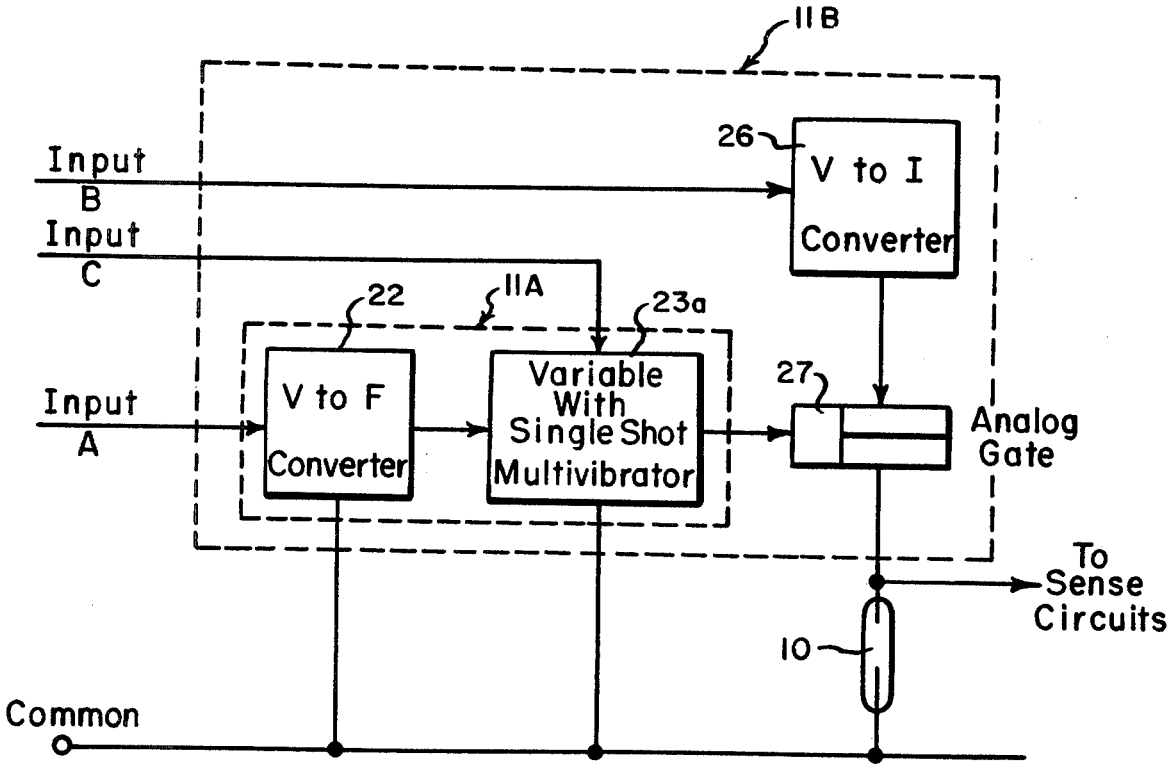
FIG. 16 is a block diagram of a three variable integrating circuit in accordance with the invention.

FIG. 16 is a block diagram of a 3 variable integrating circuit in accordance with the invention. This arrangement is similar to that of FIG. 12 except that a third input variable is used to modulate the width of the single shot multivibrator, identified as element 23A in the drawing. As will be apparent, the integral stored by coulometer 10 of FIG. 16 is the integral of the product of the 3 inputs.

3. Last State Memory Circuits (FIGS. 13–15)

The need for continuously applied pulses to determine the coulometer's state can be circumvented by storing the coulometer's state after each applied pulse.

Figure 13:
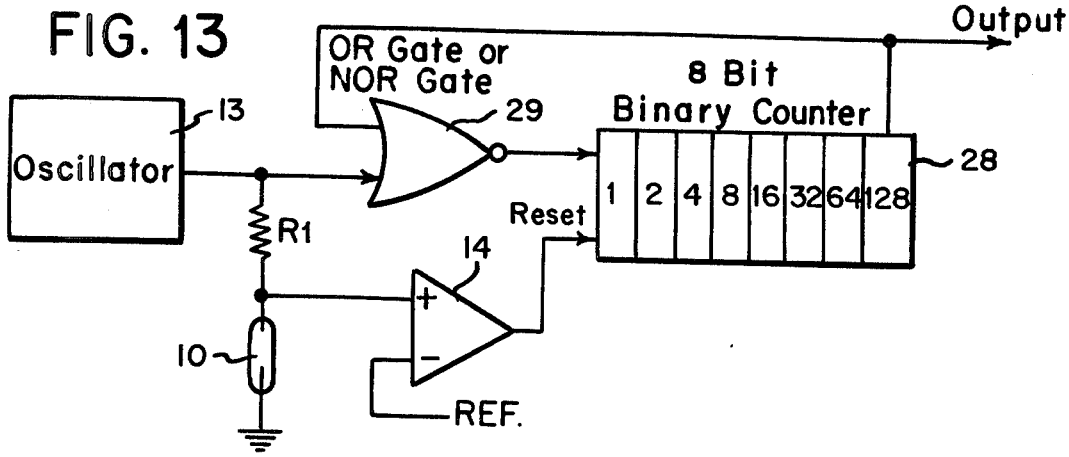
FIG. 13 is a block diagram of a last state memory circuit for detecting the shorted state of a coulometer by multiple missed pulses.

FIG. 13 is a block diagram of a last state memory circuit for detecting the shorted state by multiple missed pulses. In substance, the circuit comprises a binary counter 28, such as an 8-bit binary counter, with its set input connected to oscillator 13 through OR gate 29 as its reset input connected to the output of comparator 14. In operation, each pulse from the oscillator which is "missed" by the coulometer and comparator is counted in counter 28. However, each oscillator pulse which is picked up by the coulometer and comparator resets the entire counter. Thus, the binary counter allows accumulation of a number of consecutive missing pulses, 128 in an 8-bit counter, before making a decision concerning the shorted state. Thus, 128 consecutive oscillator pulses without a single reset pulse causes the last state of the counter to go high, producing a high output and simultaneously locking out further inputs. If, however, at least one reset pulse has been generated by the comparator within the last 127 oscillator pulses, the counter would have been reset and the output would remain low.

Figure 14:
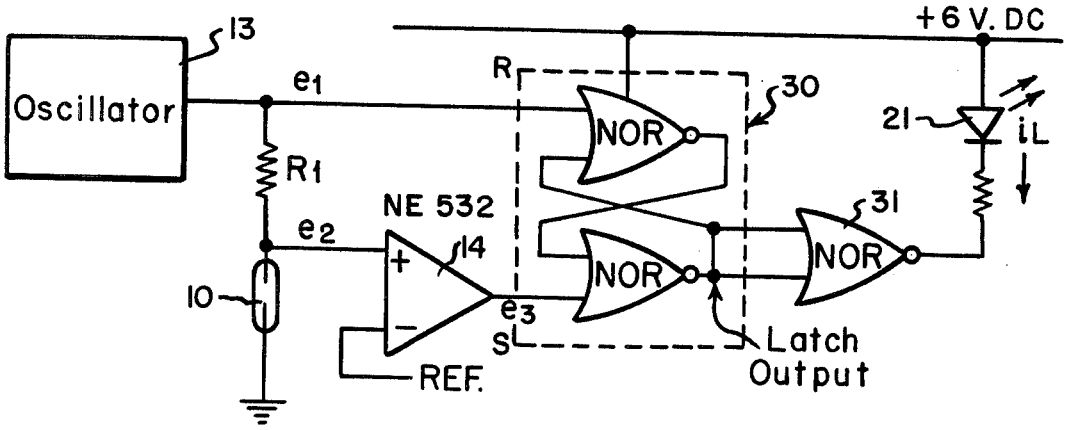
FIG. 14 is a block diagram of a second embodiment of a last state memory circuit for detecting the shorted states of a coulometer.
Figure 15:
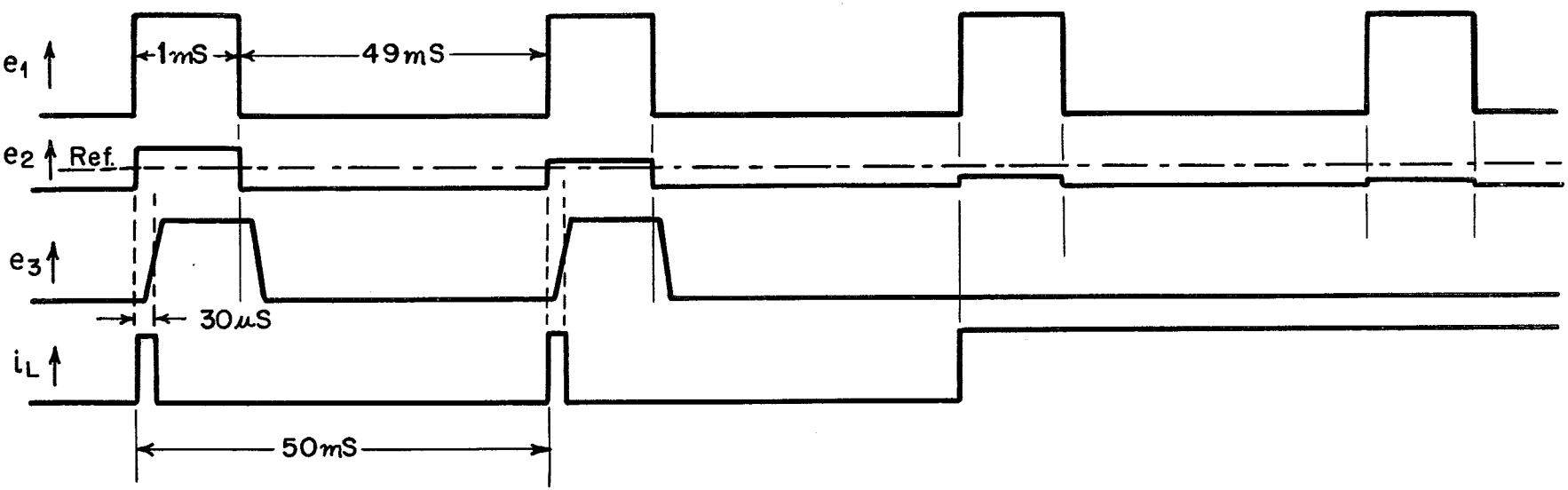
FIG. 15 is a timing diagram of various typical waveforms present in the operation of the circuit of FIG. 14.

FIG. 14 is a block diagram of a second embodiment of a last state memory circuit for detecting the shorted state. In substance, the circuit comprises a NOR gate R S flip-flop or latch with its reset input connected to oscillator 13 and its set input connected to the output of comparator 14. The complementary output of the latch is connected via NOR gate 31 to light emitting diode 21.

FIG. 15 is a timing diagram useful in understanding the operation of this circuit. A pulse from oscillator 13 always precedes the corresponding output pulse, if any, from comparator 14. This is because of the inherent delay, on the order of 30 microseconds, introduced by the comparator. Thus, at the outset of a pulse, the complementary output of the latch goes high as $e_1$ from the oscillator to the reset input is always a binary 1 at the outset and $e_3$ from the comparator to the set input is always a binary 0. Unless the coulometer is shorted, $e_3$ then rises to a binary 1 within about 30 microseconds and $e_1$ returns to a logical zero. Thus, the latch is set, causing the complementary output to go low.

If the coulometer is in the shorted state, $e_3$ remains low and the complementary output of the latch remains high. Thus, the current through the LED changes from a very small duty cycle, on the order of 1/1667, to a full on condition. Visually, the LED appears in an off condition prior to shorting and in an on condition after shorting. In subdued lighting, however, a trained observer can detect during the non-shorted condition faint flashes of light resulting from the thirty microsecond pulses.

While the invention has been described in connection with a small number of specific embodiments, it is to be understood that these are merely illustrative of the many other specific embodiments which can also utilize the principles of the invention. Thus, numerous are varied devices can be made by those skilled in the art without departing from the spirit and scope of the present invention.

I claim:

1. A coulometric device for performing integration or timing functions comprising:

a source of pulsed d.c. current representative of one or more quantities to be integrated;

a mercury coulometer to which said pulsed d.c. current is applied; and means for detecting a reduction in the voltage drop across said coulometer.

2. A coulometric device according to claim 1 wherein said source of pulsed d.c. current is a source having a duty cycle of 1 part in more than approximately 1000 and a peak current of between about 100 microamperes and 10 milliamperes.

3. A coulometric device according to claim 1 wherein said source of pulsed d.c. current has an adjustable duty cycle.

4. A coulometric device according to claim 1 wherein said source of pulsed d.c. current has an adjustable peak current.

5. A coulometer device according to claim 1, wherein said source of pulsed d.c. current has an adjustable d.c. pulse width.

6. A coulometric device for integrating a variable with respect to time comprising:

a source of pulsed d.c. current having a variable duty cycle and a substantially constant peak current;

a mercury coulometer to which said pulsed d.c. current is applied;

means for varying said duty cycle substantially in proportion to said variable to be integrated; and means for detecting a reduction in the voltage drop across said coulometer.

7. A coulometric device for integrating a variable with respect to time comprising:

a source of pulsed d.c. current having a substantially constant duty cycle and a variable peak current;

a mercury coulometer to which said pulsed d.c. current is applied;

means for varying said peak current substantially in proportion to said variable to be integrated; and means for detecting a reduction in the voltage drop across said coulometer.

8. A coulometric device for integrating the product of the two variables with respect to time comprising:

a source of pulsed d.c. current having a variable duty cycle and a variable peak current;

a mercury coulometer to which said pulsed d.c. current is applied;

means for varying said duty cycle substantially in proportion to one of said two variables;

means for varying said peak current substantially in proportion to the other of said two variables; and means for detecting a reduction in the voltage drop across said coulometer.

9. A coulometric device for integrating the product of three variables with respect to time comprising:

a source of pulsed d.c. current having a variable frequency, a variable peak current, and a variable pulse width;

a mercury coulometer to which said pulsed d.c. current is applied;

means for varying said frequency substantially in proportion to one of said three variables;

means for varying said peak current substantially in proportion to a second of said three variables;

means for varying said pulse width substantially in proportion to a third of said three variables; and means for detecting a reduction in the voltage drop across said coulometer.

10. A coulometric device according to any one of claims 1, 6, 7, 8 and 9 wherein said detecting means comprises a comparator for comparing the voltage drop across the coulometer with a reference voltage.

* * * * *